US010977976B2

(12) United States Patent
Wu

(10) Patent No.: US 10,977,976 B2
(45) Date of Patent: Apr. 13, 2021

(54) CIRCUIT STRUCTURE OF NARROW BEZEL BENDABLE DISPLAY PANEL

(71) Applicant: Wuhan China Star Optoelectronics Semiconductor Display Technology Co., Ltd., Wuhan (CN)

(72) Inventor: Shaojing Wu, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 11 days.

(21) Appl. No.: 16/471,578

(22) PCT Filed: Dec. 20, 2018

(86) PCT No.: PCT/CN2018/122478
§ 371 (c)(1),
(2) Date: Jun. 20, 2019

(87) PCT Pub. No.: WO2020/098072
PCT Pub. Date: May 22, 2020

(65) Prior Publication Data

US 2020/0193887 A1 Jun. 18, 2020

(30) Foreign Application Priority Data

Nov. 15, 2018 (CN) ..... 201811359176.0

(51) Int. Cl.
*G09G 5/00* (2006.01)
*G09G 3/20* (2006.01)

(52) U.S. Cl.
CPC ..... *G09G 3/20* (2013.01); *G09G 2300/0426* (2013.01); *G09G 2310/027* (2013.01); *G09G 2310/0297* (2013.01)

(58) Field of Classification Search
CPC ..... G09G 3/20; G09G 3/32; G09G 3/3208; G09G 2300/0426; G09G 2300/0465; G09G 2310/027; G09G 2310/0281; G09G 2310/0297
See application file for complete search history.

(56) References Cited

U.S. PATENT DOCUMENTS

| | | | | |
|---|---|---|---|---|
| 8,004,480 | B2 * | 8/2011 | Kim | G09G 3/3291 345/82 |
| 9,495,893 | B2 * | 11/2016 | Park | G09G 3/3208 |
| 10,163,999 | B2 * | 12/2018 | Park | G09G 3/3233 |
| 10,553,667 | B2 * | 2/2020 | Bae | H01L 27/1244 |
| 10,672,312 | B2 * | 6/2020 | Park | G09G 3/3266 |

(Continued)

FOREIGN PATENT DOCUMENTS

| | | |
|---|---|---|
| CN | 104009044 | 8/2014 |
| CN | 106847864 | 6/2017 |

(Continued)

*Primary Examiner* — Vijay Shankar

(57) ABSTRACT

A display panel is provided. The display panel includes a display portion and a peripheral portion, the peripheral portion is provided with a bending portion, a demultiplexing circuit, and a data driving circuit. The data driving circuit is located at a side of the peripheral portion that is away from the display portion, and the demultiplexing circuit is located between the data driving circuit and the bending portion. Thus, the bezel of the display panel can be narrowed.

20 Claims, 2 Drawing Sheets

(56) References Cited

U.S. PATENT DOCUMENTS

| | | | | |
|---|---|---|---|---|
| 10,706,800 | B1 * | 7/2020 | Chen | G09G 3/3648 |
| 2006/0123293 | A1 * | 6/2006 | Kim | G09G 3/3291<br>714/724 |
| 2014/0300649 | A1 * | 10/2014 | Park | G09G 3/3208<br>345/690 |
| 2016/0268318 | A1 | 9/2016 | Zhou | |
| 2019/0244976 | A1 | 8/2019 | Zhu | |
| 2019/0385976 | A1 | 12/2019 | Zha | |

FOREIGN PATENT DOCUMENTS

| | | |
|---|---|---|
| CN | 206574411 | 10/2017 |
| CN | 107357068 | 11/2017 |
| CN | 108122497 | 6/2018 |

* cited by examiner

CIRCUIT STRUCTURE OF NARROW BEZEL BENDABLE DISPLAY PANEL

RELATED APPLICATIONS

This application is a National Phase of PCT Patent Application No. PCT/CN2018/122478 having International filing date of Dec. 20, 2018, which claims the benefit of priority of Chinese Patent Application No. 201811359176.0 filed on Nov. 15, 2018. The contents of the above applications are all incorporated by reference as if fully set forth herein in their entirety.

FIELD AND BACKGROUND OF THE INVENTION

The present invention relates to a field of display technologies, and in particular, to a display panel.

In a conventional display panel, a bending portion is generally disposed in a peripheral portion of the display panel, and devices which are located outside (a side away from a display portion) of the peripheral portion can be accommodated at a back surface of the display panel.

The peripheral portion of the conventional display panel generally further includes a device such as a demultiplexing circuit, the demultiplexing circuit is disposed at a side of the peripheral portion that is close to a display portion. Therefore, the bending portion and the display portion exist a larger gap. When the bending portion is bent, a greater distance exists between an edge line of the display portion and a bending line of the bending portion, that is disadvantageous for achieving a narrow bezel of the display panel.

Therefore, it is necessary to propose a new technical solution to solve the above technical problems.

SUMMARY OF THE INVENTION

An object of the present invention is to provide a display panel that can make the bezel of the display panel narrower.

In order to solve the above problems, the technical solutions of the present invention are as follows:

A display panel, including a display portion and a peripheral portion, the peripheral portion disposed on at least one side of the display portion; wherein the peripheral portion is provided with a bending portion, a demultiplexing circuit and a data driving circuit, an output interface of the data driving circuit is electrically connected to an input interface of the demultiplexing circuit, and an output interface of the demultiplexing circuit is electrically connected to an input interface of the display portion; wherein the data driving circuit is located at a side of the peripheral portion that is away from the display portion, and the demultiplexing circuit is located between the data driving circuit and the bending portion; wherein the peripheral portion is further provided with a signal routing portion and a power routing portion, the signal routing portion and the power routing portion are respectively located in two different film layers of the peripheral portion; wherein the bending portion is disposed at the peripheral portion which is close to the display portion; and wherein the bending portion is long-strip shape, and a straight line corresponding to the bending portion is parallel to an edge line where the display portion and the peripheral portion join together.

In the above display panel, the signal routing portion includes a first signal routing portion and a second signal routing portion, the first signal routing portion is disposed between the bending portion and the demultiplexing circuit, and the second signal routing portion is disposed between the bending portion and the display portion.

In the above display panel, the first signal routing portion is electrically connected to the output interface of the demultiplexing circuit, the first signal routing portion is electrically connected to the second signal routing portion, and the second signal routing portion is electrically connected to the input interface of the display portion.

In the above display panel, the power routing portion is electrically connected to the data driving circuit and the display portion.

A display panel, including a display portion and a peripheral portion, the peripheral portion disposed on at least one side of the display portion; wherein the peripheral portion is provided with a bending portion, a demultiplexing circuit and a data driving circuit, an output interface of the data driving circuit is electrically connected to an input interface of the demultiplexing circuit, and an output interface of the demultiplexing circuit is electrically connected to an input interface of the display portion; and wherein the data driving circuit is located at a side of the peripheral portion that is away from the display portion, and the demultiplexing circuit is located between the data driving circuit and the bending portion.

In the above display panel, the peripheral portion is further provided with a signal routing portion and a power routing portion, the signal routing portion and the power routing portion are respectively located in two different film layers of the peripheral portion.

In the above display panel, the signal routing portion includes a first signal routing portion and a second signal routing portion, the first signal routing portion is disposed between the bending portion and the demultiplexing circuit, and the second signal routing portion is disposed between the bending portion and the display portion.

In the above display panel, the first signal routing portion is electrically connected to the output interface of the demultiplexing circuit, the first signal routing portion is electrically connected to the second signal routing portion, and the second signal routing portion is electrically connected to the input interface of the display portion.

In the above display panel, the first signal routing portion passes through the bending portion and is electrically connected to the second signal routing portion.

In the above display panel, the second signal routing portion passes through the bending portion and is electrically connected to the first signal routing portion.

In the above display panel, the power routing portion is electrically connected to the data driving circuit and the display portion.

In the above display panel, the power routing portion is disposed between the display portion and the bending portion.

In the above display panel, the power routing portion includes a first power routing portion and a second power routing portion, and the second power routing portion is disposed between the bending portion and the demultiplexing circuit; the first power routing portion is disposed between the display portion and the bending portion, or the first power routing portion is disposed at a side of the display portion that is away from the peripheral portion.

In the above display panel, the first power routing portion is electrically connected to the input interface of the display portion, the second power routing portion is electrically connected to the first power routing portion.

In the above display panel, the first power routing portion is disposed between the display portion and the bending portion.

In the above display panel, the first power routing portion is disposed at a side of the display portion that is away from the peripheral portion.

In the above display panel, an insulating film layer is disposed between the signal routing portion and the power routing portion.

In the above display panel, the bending portion is disposed at the peripheral portion which is close to the display portion.

In the above display panel, the bending portion is long-strip shape, and a straight line corresponding to the bending portion is parallel to an edge line where the display portion and the peripheral portion join together.

In the above display panel, in a case that the peripheral region is in a bending state, a portion of the peripheral portion partially located at a side of the bending portion that is away from the display portion is accommodated at a back surface of the display portion and/or a back surface of a portion of the peripheral portion which is located between the bending portion and the display portion.

Compared with the conventional art, because a demultiplexing circuit is disposed between a bending portion and a data driving circuit, the bending portion can be closer to a display portion, that is, a space (gap) which is between the display portion and the bending portion can be reduced, and it is advantageous to make bezel of a display panel narrower.

In order to make the above description of the present invention clearer and more understandable, preferred embodiments are described hereafter, and in conjunction with the accompanying drawings, the detailed description is as follows.

DESCRIPTION OF SPECIFIC EMBODIMENTS OF THE INVENTION

The term "embodiment" as used in this specification means an implementation, an example or an illustration. In addition, the articles "a", "an", or "one" used in this specification and the appended claims may be generally interpreted as "one or more", unless specified otherwise or clearly indicated in the context to determine a singular form.

Figure 1:
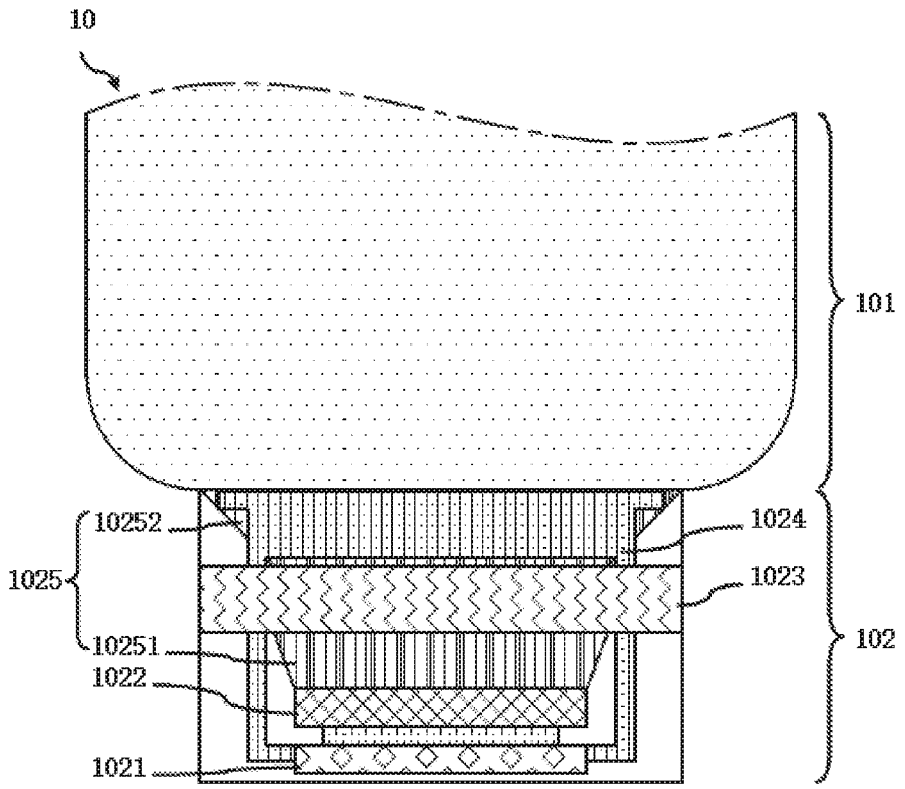
FIG. 1 is a schematic view of a display panel of a first embodiment of the present invention.

Referring to FIG. 1, FIG. 1 is a schematic view of a display panel 10 of a first embodiment of the present invention.

The display panel 10 of the present invention may be an organic light emitting diode (OLED) panel or the like.

The display panel 10 of the present invention includes a display portion 101 and a peripheral portion 102, and the peripheral portion 102 is disposed on at least one side of the display portion 101. For example, the peripheral portion 102 is disposed on a lower side of the display portion 101.

The peripheral portion 102 is provided with a bending portion 1023, a demultiplexing circuit 1022, and a data driving circuit 1021. An output interface of the data driving circuit 1021 is electrically connected to an input interface of the demultiplexing circuit 1022, and an output interface of the demultiplexing circuit 1022 is electrically connected to an input interface of the display portion 101.

The data driving circuit 1021 is located on a side of the peripheral portion 102 away from the display portion 101, and the demultiplexing circuit 1022 is located between the data driving circuit 1021 and the bending portion 1023.

The bending portion 1023 is disposed at a position of the peripheral portion 102 which is close to the display portion 101. The bending portion 1023 is a long-strip shape, and a straight line corresponding to the bending portion 1023 is parallel to an edge line where the display portion 101 and the peripheral portion 102 join together.

The peripheral portion 102 is configured to bend at the bending portion 1023 to make the bezel of the display panel 10 narrower. Specifically, in a case that the peripheral portion is in a bending state, a portion of the peripheral portion 102 partially located at a side of the bending portion 1023 that is away from the display portion 101 is accommodated at a back surface of the display portion 101 and/or a back surface of a portion of the peripheral portion 102 which is located between the bending portion 1023 and the display portion 101.

The peripheral portion 102 is further provided with a signal routing portion 1025 and a power routing portion 1024, the signal routing portion 1025 and the power routing portion 1024 are respectively located in two different film layers of the peripheral portion 102. An insulating film layer is disposed between the signal routing portion 1025 and the power routing portion 1024.

The signal routing portion 1025 includes a first signal routing portion 10251 and a second signal routing portion 10252, the first signal routing portion 10251 is disposed between the bending portion 1023 and the demultiplexing circuit 1022, and the second signal routing portion 10252 is disposed between the bending portion 1023 and the display portion 101.

The signal routing portion 1025 is electrically connected to the display portion 101 and the demultiplexing circuit 1022. Specifically, the first signal routing portion 10251 is electrically connected to the output interface of the demultiplexing circuit 1022, the first signal routing portion 10251 is electrically connected to the second signal routing portion 10252, and the second signal routing portion 10252 is electrically connected to the input interface of the display portion 101.

The first signal routing portion 10251 and the second signal routing portion 10252 are both configured in a fan shape.

The first signal routing portion 10251 passes through the bending portion 1023 and is electrically connected to the second signal routing portion 10252, or the second signal routing portion 10252 passes through the bending portion 1023 and is electrically connected to the first signal routing portion 10251. The first signal routing portion 10251 or the second signal routing portion 10252 passes through the bending portion 1023 on a plane corresponding to the peripheral portion 102.

The power routing portion 1024 is electrically connected to the data driving circuit 1021 and the display portion 101.

The power routing portion 1024 is disposed between the display portion 101 and the bending portion 1023.

The peripheral portion 102 further includes M demultiplexing control lines, and the demultiplexing control lines are electrically connected to the demultiplexing circuit 1022. Correspondingly, the output interface of the data driving circuit 1021 has M output terminals.

The output interface of the demultiplexing circuit 1022 includes N output combinations and each of the output combinations includes M output terminals.

The demultiplexing circuit 1022 includes N switch combinations, each of the switch combinations includes M triode switches, the triode switch includes a control terminal, an output terminal, and an input terminal. The control terminal is electrically connected to one of the demultiplexing control lines. The output terminal is electrically connected to a signal wire of the first signal routing portion 10251. Input terminals of the M triode switches in the same switch combination are all electrically connected to an output terminal of the output interface of the data driving circuit 1021.

That is, the demultiplexing circuit 1022 is configured to demultiplex a data signal outputted by the data driving circuit 1021 into M data signals, and separately input to the M columns of pixel columns of the display portion 101 through the signal routing portion 1025.

N and M are integers greater than one.

According to the above technical solutions, because the demultiplexing circuit 1022 is disposed between the bending portion 1023 and the data driving circuit 1021, so that the bending portion 1023 can be closer to the display portion 101. That is, the above technical solutions reduce a space (gap) between the display portion 101 and the bending portion 1023, a result that is advantageous for making the bezel of the display panel 10 narrower.

Figure 2:
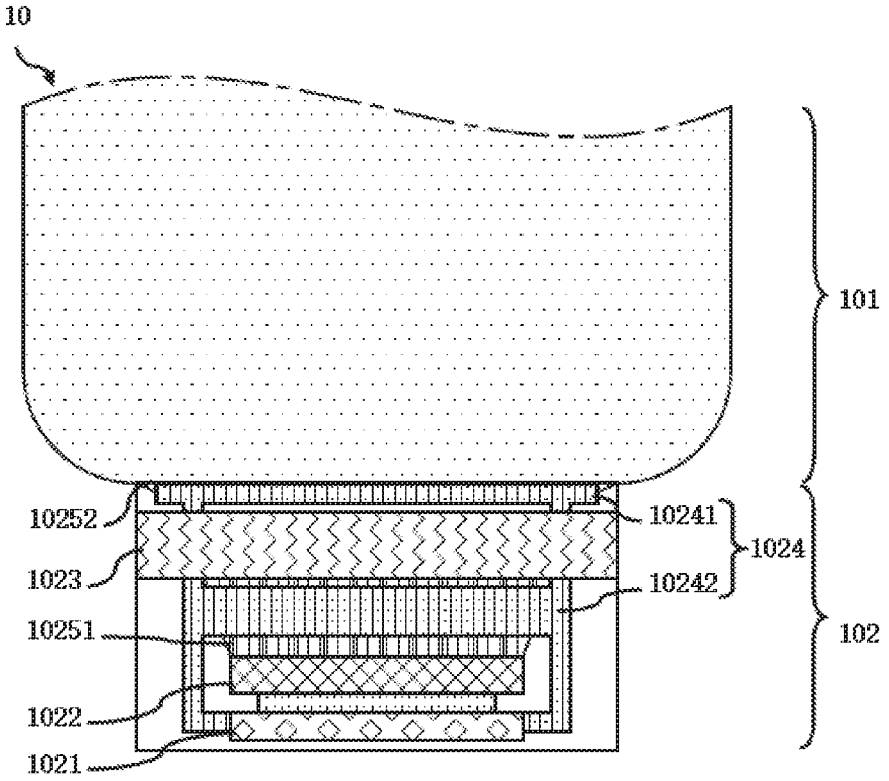
FIG. 2 is a schematic view of a display panel of a second embodiment of the present invention.

Referring to FIG. 2, FIG. 2 is a schematic view of a second embodiment of the display panel 10 of the present invention. This embodiment is similar to the first embodiment which is described above, the differences are that:

The power routing portion 1024 includes a first power routing portion 10241 and a second power routing portion 10242, and the second power routing portion 10242 is disposed between the bending portion 1023 and the demultiplexing circuit 1022.

The first power routing portion 10241 is disposed between the display portion 101 and the bending portion 1023, and the first power routing portion 10241 is electrically connected to the input interface of the display portion 101, and the second power routing portion 10242 is electrically connected to the first power routing portion 10241.

According to the above technical solutions, because a part of the power routing portion 1024 is disposed on a side of the bending portion 1023 that is away from the display portion 101, and only another part of the power routing portion 1024 is reserved between the display portion 101 and the bending portion 1023, so that the bending portion 1023 can be further closer to the display portion 101. That is, the above technical solutions further reduce the space (gap) between the display portion 101 and the bending portion 1023, a result that is advantageous for making the bezel of the display panel 10 narrower.

A third embodiment of the present invention is similar to the second embodiment which is described above, the difference is that:

The first power routing portion 10241 is disposed on a side of the display portion 101 that is away from the peripheral portion 102.

According to the above technical solution, a part of the power routing portion 1024 is disposed on the side of the display portion 101 that is away from the peripheral portion, so that the bending portion 1023 can be further closer to the display portion 101, that is, the above technical solution is further reduced the space (gap) between the display portion 101 and the bending portion 1023, results that are advantageous for making the bezel of the display panel 10 narrower.

In summary, the present invention has been disclosed in the above preferred embodiments, but these preferred embodiments are not intended to limit the scope of the present invention, and those skilled in the art can make various modifications and improvements without departing from the spirit and scope of the invention. Therefore, the scope of the invention is defined by the scope of the claims.

What is claimed is:

1. A display panel, comprising a display portion and a peripheral portion, the peripheral portion disposed on at least one side of the display portion;

wherein the peripheral portion is provided with a display panel bendable portion, a demultiplexing circuit, and a data driving circuit; an output interface of the data driving circuit is electrically connected to an input interface of the demultiplexing circuit, and an output interface of the demultiplexing circuit is electrically connected to an input interface of the display portion;

wherein the data driving circuit is located at a side of the peripheral portion that is away from the display portion, and the demultiplexing circuit is located between the data driving circuit and the display panel bendable portion;

wherein the peripheral portion is further provided with a signal routing portion and a power routing portion, the signal routing portion and the power routing portion are respectively located in two different film layers of the peripheral portion;

wherein the display panel bendable portion is disposed at the peripheral portion which is close to the display portion; and wherein the display panel bendable portion is long-strip shape, and a straight line corresponding to the display panel bendable portion is parallel to an edge line where the display portion and the peripheral portion join together.

2. The display panel according to claim 1, wherein the signal routing portion comprises a first signal routing portion and a second signal routing portion, the first signal routing portion is disposed between the display panel bendable portion and the demultiplexing circuit, and the second signal routing portion is disposed between the display panel bendable portion and the display portion.

3. The display panel according to claim 2, wherein the first signal routing portion is electrically connected to the output interface of the demultiplexing circuit, the first signal routing portion is electrically connected to the second signal routing portion, and the second signal routing portion is electrically connected to the input interface of the display portion.

4. The display panel according to claim 1, wherein the power routing portion is electrically connected to the data driving circuit and the display portion.

5. A display panel, comprising a display portion and a peripheral portion, the peripheral portion disposed on at least one side of the display portion;

wherein the peripheral portion is provided with a display panel bendable portion, a demultiplexing circuit, and a data driving circuit; an output interface of the data driving circuit is electrically connected to an input interface of the demultiplexing circuit, and an output interface of the demultiplexing circuit is electrically connected to an input interface of the display portion; and wherein the data driving circuit is located at a side of the peripheral portion that is away from the display portion, and the demultiplexing circuit is located between the data driving circuit and the display panel bendable portion.

6. The display panel according to claim 5, wherein the peripheral portion is further provided with a signal routing portion and a power routing portion, the signal routing portion and the power routing portion are respectively located in two different film layers of the peripheral portion.

7. The display panel according to claim 6, wherein the signal routing portion comprises a first signal routing portion and a second signal routing portion, the first signal routing portion is disposed between the display panel bendable portion and the demultiplexing circuit, and the second signal routing portion is disposed between the display panel bendable portion and the display portion.

8. The display panel according to claim 7, wherein the first signal routing portion is electrically connected to the output interface of the demultiplexing circuit, the first signal routing portion is electrically connected to the second signal routing portion, and the second signal routing portion is electrically connected to the input interface of the display portion.

9. The display panel according to claim 8, wherein the first signal routing portion passes through the display panel bendable portion and is electrically connected to the second signal routing portion.

10. The display panel according to claim 8, wherein the second signal routing portion passes through the display panel bendable portion and is electrically connected to the first signal routing portion.

11. The display panel according to claim 6, wherein the power routing portion is electrically connected to the data driving circuit and the display portion.

12. The display panel according to claim 11, wherein the power routing portion is disposed between the display portion and the display panel bendable portion.

13. The display panel according to claim 11, wherein the power routing portion comprises a first power routing portion and a second power routing portion, and the second power routing portion is disposed between the display panel bendable portion and the demultiplexing circuit.

14. The display panel according to claim 13, wherein the first power routing portion is electrically connected to the input interface of the display portion, the second power routing portion is electrically connected to the first power routing portion.

15. The display panel according to claim 14, wherein the first power routing portion is disposed between the display portion and the display panel bendable portion.

16. The display panel according to claim 14, wherein the first power routing portion is disposed at a side of the display portion that is away from the peripheral portion.

17. The display panel according to claim 6, wherein an insulating film layer is disposed between the signal routing portion and the power routing portion.

18. The display panel according to claim 5, wherein the display panel bendable portion is disposed at the peripheral portion which is close to the display portion.

19. The display panel according to claim 5, wherein the display panel bendable portion is long-strip shape, and a straight line corresponding to the display panel bendable portion is parallel to an edge line where the display portion and the peripheral portion join together.

20. The display panel according to claim 19, wherein, in a case that the peripheral portion is in a bending state, a portion of the peripheral portion partially located at a side of the display panel bendable portion that is away from the display portion is accommodated at a back surface of the display portion and/or a back surface of a portion of the peripheral portion which is located between the display panel bendable portion and the display portion.

* * * * *